US005629662A

United States Patent [19]

Floyd et al.

[11] Patent Number: 5,629,662

[45] Date of Patent: May 13, 1997

[54] LOW ENERGY MEMORY METAL ACTUATED LATCH

[75] Inventors: Bruce G. Floyd; Jack E. Steinhilper, both of Lilburn, Ga.

[73] Assignee: Siemens Energy & Automation, Inc., Alpharetta, Ga.

[21] Appl. No.: 382,474

[22] Filed: Feb. 1, 1995

[51] Int. Cl.[6] ..... H01H 61/00

[52] U.S. Cl. ..... 337/36; 337/47

[58] Field of Search ..... 337/36, 37, 38, 337/39, 46, 47, 48, 52

[56] References Cited

U.S. PATENT DOCUMENTS

| | | | |
|---|---|---|---|
| 3,821,607 | 6/1974 | Lange et al. . | |
| 4,166,993 | 9/1979 | Krasser | 337/66 |
| 4,814,737 | 3/1989 | Ebnet | 337/49 |
| 5,151,674 | 9/1992 | Flohr . | |

FOREIGN PATENT DOCUMENTS

| | | |
|---|---|---|
| 0037490 | 10/1981 | European Pat. Off. . |
| 1455321 | 10/1966 | France . |
| 2389990 | 12/1978 | France . |
| 3338799 | 5/1985 | Germany . |
| 4100772 | 7/1991 | Germany . |
| 8903116 | 4/1989 | WIPO . |

OTHER PUBLICATIONS

*F&M Feinwerktechnik Mikrotechnik Messtechnik*, vol. 102, No. 1/02. Jan. 1, 1994, pp. 35–37, D. Voss, "Formegdachtnis Legierungen, Einsatzmoglichkeiten In Der Aktorik Shape Memorizing Alloys. Applications In Actorics".

European Search Report for EP 96 00705.

*Primary Examiner*—Lincoln Donovan

[57] ABSTRACT

A low energy electromechanical interface for a circuit breaker, magnetic latch, shunt trip device, undervoltage relay, contactor, or other electric switch utilizes a memory wire to initiate the tripping of the circuit breaker. The memory wire is mechanically coupled to a latch which captures a plunger in a biased state. When the memory wire receives energy such as heat or an electric signal, the memory wire contracts and causes the latch to release a spring loaded plunger. When the plunger is released, the plunger engages a trip bar and trips the electric switch. Preferably, the memory metal wire is a nickel-titanium wire. The low cost electromechanical interface may replace more expensive solenoid and magnetic latch devices. The interface may be advantageously retrofitted into existing circuit breaker and switch designs.

37 Claims, 2 Drawing Sheets

LOW ENERGY MEMORY METAL ACTUATED LATCH

BACKGROUND OF THE INVENTION

The present invention relates to an electric switching device such as a circuit breaker, magnetic latch, shunt trip device, undervoltage relay, or overload protection circuit for an electrical load such as a motor, appliance, or electrical network. In particular, the present invention relates to a control mechanism for a circuit breaker which opens a set of contacts in response to a detection of a trip condition such as an overload, fault, or other error condition.

Circuit breakers often include a contact arm operating mechanism mechanically coupled with at least one contact arm and associated contact or a cross-bar assembly connected to the contact arms of a multi-phase circuit breaker. A trip apparatus (e.g., overload solenoid) often includes a moveable core (e.g., a plunger, a pivoting actuator arm, overload relay, or bimetal trip arrangement.) Generally, when a circuit breaker or other switch is in an overload, fault, error or other trip condition, the set of contacts is opened or the switch is otherwise open circuited when the trip apparatus activates the contact arm operating mechanism.

The trip apparatus generally includes a mechanical or electromagnetic plunger control. When the trip apparatus and control cooperate to move the plunger or actuator arm from a first position to a second position, the plunger activates the contact arm operating mechanism which opens the contacts. A mechanical plunger control may utilize a bimetal element to trigger, induce or provide the mechanical motion of the plunger. In an electromagnetic plunger control, the mechanical motion is often provided by a solenoid including a coil. When the coil is energized and maintained energized, the plunger activates the contact arm operating mechanism to open the contacts of the circuit breaker.

Conventional circuit breakers often utilize a bimetal trip arrangement to open the circuit breaker in response to a trip condition. The bimetal element is normally coupled in series with the load and the circuit breaker contacts. The bimetal element is heated by current applied to the load coupled to the circuit breaker. Accordingly, when the current applied to the load exceeds a certain threshold which indicates a trip condition, the bimetal element deforms and activates the contact arm operating mechanism, thereby directly disconnecting power to the load. Alternatively, the bimetal element may be utilized with a solenoid and disconnect current to the coil in response to the trip condition, thereby causing the circuit breaker to disconnect power to the load.

Another known type of trip apparatus includes a normally closed overload relay coupled in series with the circuit breaker. The overload relay is generally controlled by a microprocessor-based controller or other control circuit which monitors the current flowing through the circuit breaker and energizes the coil in the overload relay in response to the trip condition. Alternatively, the microprocessor-based controller may be utilized to control a magnetic latch or an electromagnetic plunger control system. The microprocessor-based controller can be configured to sense a variety of trip conditions. Based upon samples of the values of the current being applied to the load which is controlled by the switch, the microprocessor de-energizes the coil in response to the trip condition. Other microprocessor-based systems may also include temperature sensors mounted near the load. The microprocessor compares the sensed temperatures with predetermined limits and causes the switch to open de-energizing the coil when predetermined temperature limits are exceeded.

The above described systems, while providing satisfactory overload protection, are subject to a number of problems. One problem with the bimetallic based overload systems is the inability to accurately and effectively tailor the properties of the bimetallic actuator to the specifications of the load such as a motor or to the characteristics of a variety of trip conditions. Also, bimetal based overload systems waste energy because they often require relatively large amounts of current to deform. Another problem with electromagnetic based overload systems is the expense and manufacturing costs associated with the coils, magnets and overload relays. Additionally, the performance of bimetal elements as well as solenoids associated with electromagnetic plunger control systems often degrades over time. It is feasible to solve the problems with bimetallic and microprocessor based overload relays; however, these solutions may be relatively expensive and unworkable for high volume products.

Accordingly, it would be advantageous to provide a mechanical plunger control system which does not utilize a bimetal element or a solenoid.

SUMMARY OF THE INVENTION

The present invention relates to a system for interrupting current flow in a circuit breaker including a trip bar and a contact operating mechanism mechanically coupled to at least one contact. The trip bar is capable of residing in a trip state where the current flow is interrupted. The system includes a plunger, a spring, a latch, and a memory metal actuator. The plunger is positioned proximate the trip bar and is capable of residing in a first state and a second state. The spring is mechanically coupled to the plunger and biases the plunger towards the second state when the plunger is in the first state. The latch is positioned to releasably capture the plunger in the first state. The memory metal actuator is coupled to the latch and releases the latch in response to a trip signal so that the plunger changes from the first state to the second state and engages the trip bar thereby forcing the trip bar to the trip state.

The present invention also relates to a method of tripping an electric switch in response to a trip condition. The electric switch includes a trip bar, a plunger mechanism, and a memory wire. The plunger mechanism is positioned to move the trip bar from a reset state to a trip state and the memory is coupled to the plunger mechanism. The method includes the steps of providing an electric signal to the memory wire, changing shape of the memory wire from a first shape to a second shape in response to the electric signal, and moving the trip bar from the reset state to the trip state with the plunger mechanism in response to the memory wire changing from the first state to the second state.

The present invention even further relates to a circuit breaker including a set of contacts, a trip means for disengaging the set of contacts in response to a mechanical motion, a plunger means for providing the mechanical motion to the trip means, a latch means for providing the plunger means for maintaining the reset state, and a memory wire. The trip means is mechanically coupled to the set of contacts, and the latch means is mechanically coupled to the plunger means. The plunger means provides a mechanical motion so that the contacts are disengaged when the plunger means is in a release state. The latch means allows the plunger means to attain the release state when the latch means is in the unlatched state. The memory wire is mechanically coupled to the latch means and moves the latch means to the unlatched state in response to a change of shape.

The present invention even further relates to an override mechanism for a switch having a plurality of contacts. The override mechanism includes a plunger mechanism and a latch. The plunger mechanism is retained in a biased position by the latch, and the plurality of contacts are closed when the plunger mechanism is in the biased position. The improvement to the override mechanism includes a memory wire coupled to the latch. The latch releases the plunger mechanism in response to deformation of the memory wire. The plunger mechanism reaches a trip position and opens the plurality of contacts when the memory wire is deformed.

In one aspect of the present invention, a low energy, electromechanical interface disconnects the contacts in response to a trip condition. The electromechanical interface includes a nickel titanium (e.g. Flexinol™) wire coupled to a spring loaded plunger mechanism. The low energy, electromechanical interface may be advantageously retrofitted into existing circuit breaker and electronic switch devices. The electromechanical interface simplifies the manufacture of the switch, requires relatively inexpensive components, and is more reliable than conventional overload mechanisms.

DETAILED DESCRIPTION OF THE PREFERRED EMBODIMENT

Figure 1:
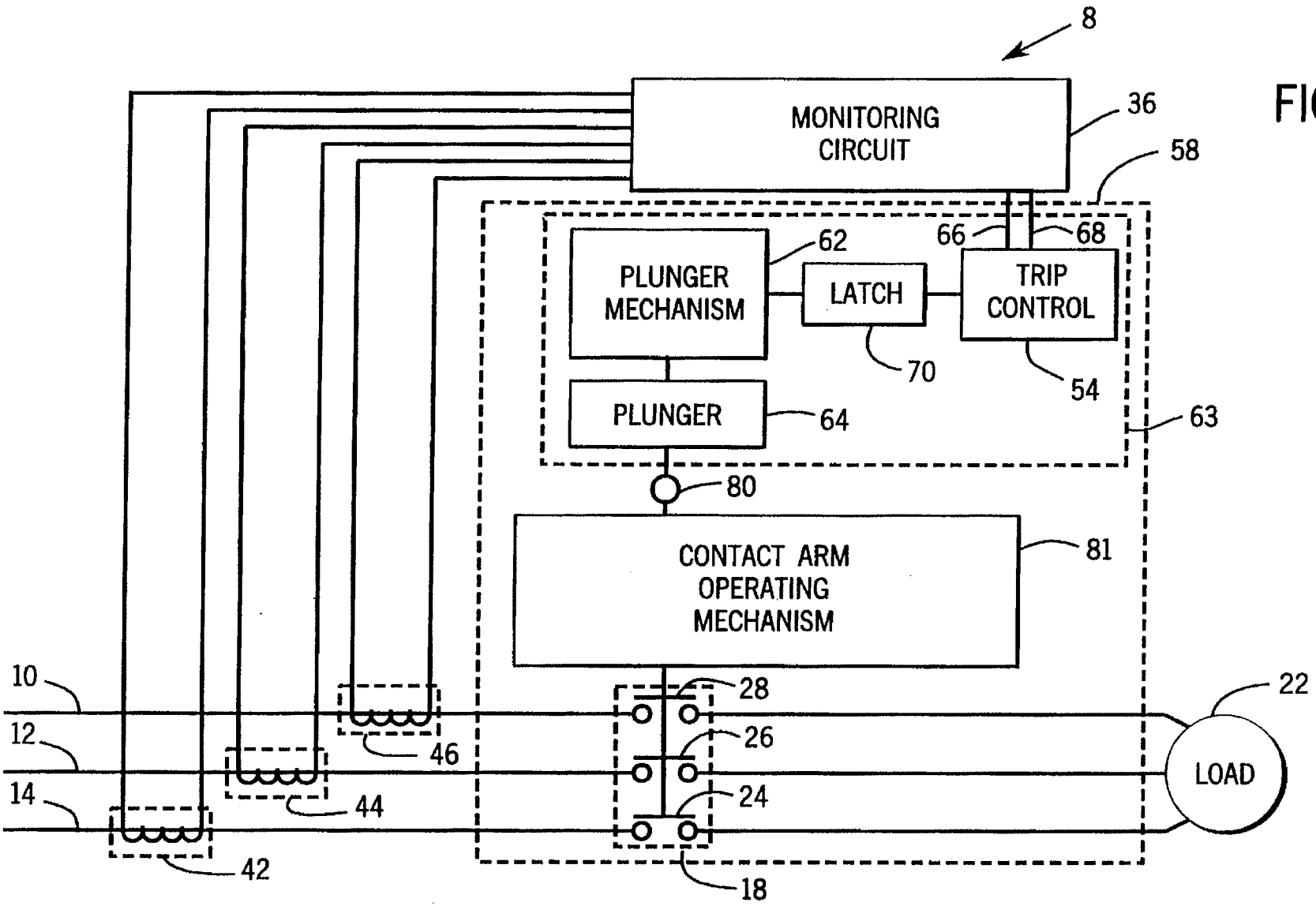
FIG. 1 is a schematic system block diagram of a circuit breaker coupled to a power supply and a load.

Referring to FIG. 1, a circuit breaker 58 may be utilized in a three-phase power supply system 8 including an A phase conductor 10, a B phase conductor 12, a C phase conductor 14, monitoring circuit 36, and a three-phase load 22 such as an electric motor, appliance, electric network, or other device. Although circuit breaker 58 is shown coupled to a three-phase power supply system 8, single-phase power, DC power, or other types of power systems and networks may be utilized. Although the present invention is described with respect to circuit breaker 58, the present invention may be utilized within other types of electric switch devices or actuators including contactors, relay switches, undervoltage relays, shunt trip devices, magnetic latches, or other load protection circuits.

Circuit breaker 58 includes a mechanical plunger control system 63, a trip lever or bar 80, and a set 18 of contacts 24, 26 and 28. Mechanical plunger control system 63 includes a plunger control interface 59, a plunger mechanism 62, a plunger 64, and a trip control 54. Set 18 includes contacts 24, 26 and 28 coupled to conductors 14, 12, and 10, respectively. Alternatively, set 18 may be a single set or pair of contacts for a single phase load.

Set 18 is mechanically coupled to a contact arm operating mechanism 81 schematically shown in FIG. 1. Contact arm operating mechanism 81 opens in response to motion of a trip bar 80 and additionally controls the state of contacts 24, 26 and 28 in response to operation of a handle (not shown) to open and close contacts 24, 26 and 28. Contact arm operating mechanism 81 preferably includes a mechanical lever arm, button or other user interface from which an operator can manipulate plunger mechanism 62 or trip bar 80 to cause mechanism 81 to open contacts 24, 26 and 28.

Trip bar 80 mechanically interacts with plunger 64 which is mechanically coupled to plunger mechanism 62. Trip control 54 is mechanically coupled to plunger mechanism 62 via a mechanical link such as a latch 70. Trip control 54 receives electric signals from monitoring circuit 36 via conductors 66 and 68.

The operation of circuit breaker 58 in response to a trip condition is described below in accordance with the preferred exemplary embodiment of the present invention with reference to FIG. 1. Contacts 24, 26, and 28 are open in the event of an overload, fault, or other trip condition by providing mechanical motion to trip bar 80.

Contact arm operating mechanism 81 is coupled to set 18 and opens contacts 24, 26 and 28 when trip bar 80 is moved in response to motion from plunger 64. The motion of trip bar 80 causes contact arm operating mechanism 81 to open contacts 24, 26 and 28. Plunger mechanism 62 is configured to provide motion to plunger 64 in response to the mechanical trip signal provided via latch 70 by trip control 54. Trip control 54 provides the mechanical trip signal on latch 70 in response to an electric trip signal from monitoring circuit 36. Alternatively, the electric trip signal may be a heat signal or other energy signal provided by monitoring circuit 36 or other trip condition sensing device.

Figure 2:
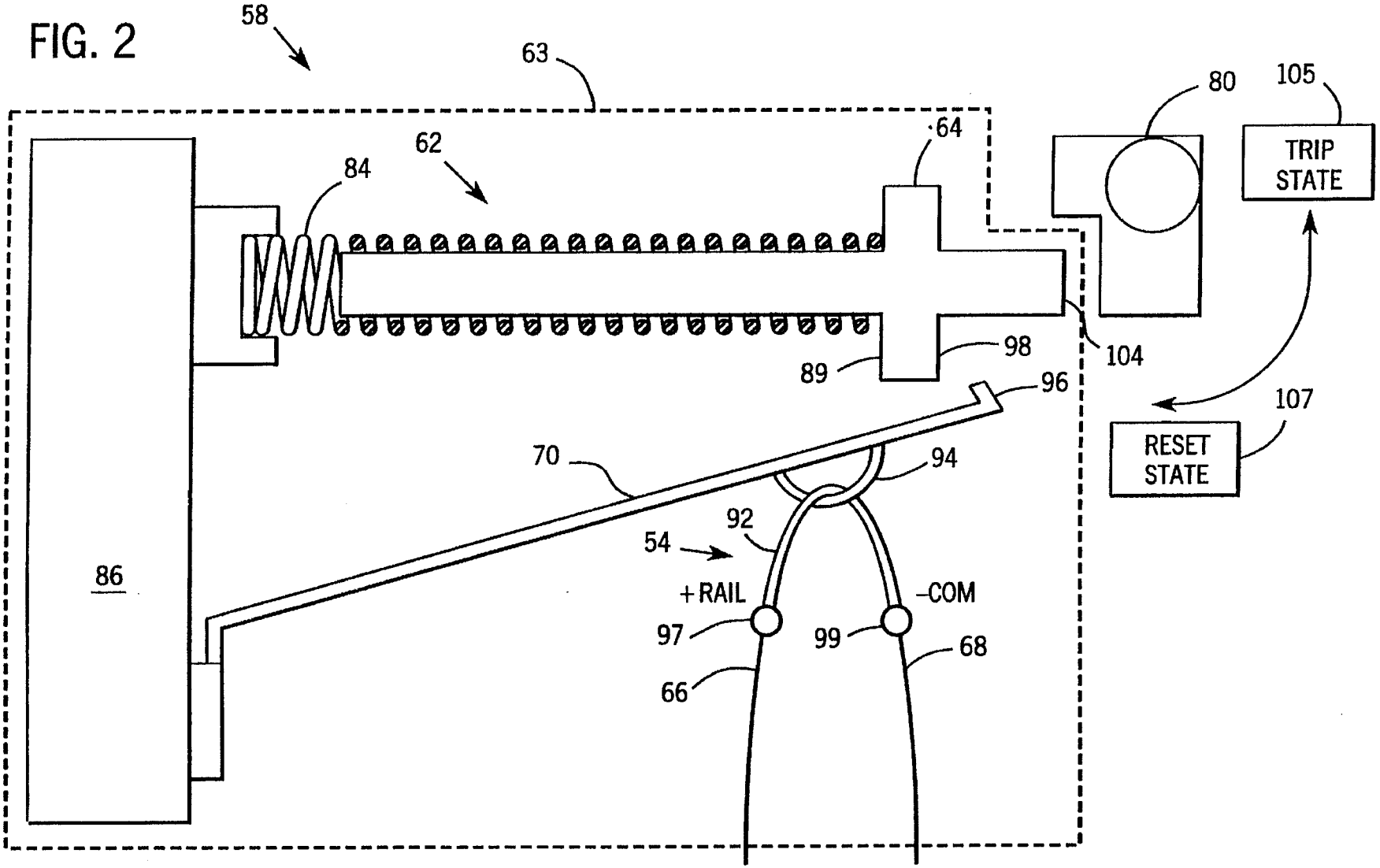
FIG. 2 is a more detailed schematic illustration of the plunger mechanism associated with the circuit breaker illustrated in FIG. 1.

Trip bar 80 is generally capable of residing in a trip state 105 or a reset state 107 (FIG. 2). Referring to FIG. 1, in trip state 105, contacts 24, 26, and 28 are opened and load 22 is disconnected from conductors 10, 12, and 14. In reset state 107, contacts 24, 26, and 28 maybe opened or closed by an operator by appropriately positioning (ON position, OFF position) of the operating handle (not shown) of circuit breaker 58.

When trip bar 80 is in reset state 107, plunger 64 is in a first position. Plunger 64 is captured or maintained in the first position by latch 70. Latch 70 maintains plunger 64 in the first position until control 54 provides the mechanical trip signal to plunger mechanism 62. Plunger mechanism 62 thrusts plunger 64 into a second position in response to the mechanical trip signal. The change of the position of plunger 64 from the first position to the second position moves trip bar 80 from reset state 107 to trip state 105, thereby opening contacts 24, 26 and 28.

Once in trip state 105, trip bar 80 may be returned to reset state by manipulating contact arm operating mechanism 81. Preferably, a lever (not shown), handle or other interface associated with mechanism 81 maybe engaged so that trip bar 80 is changed from trip state 105 to reset state 107. Preferably, the change of trip bar 80 from trip state 105 to reset state 107 causes trip bar 80 to engage plunger 64 and force plunger 64 from the second position to the first position. Once in the first position, plunger 64 is preferably captured by latch 70 and held in the first position until trip control 54 provides the mechanical trip signal.

Trip control 54 preferably provides the mechanical trip signal in response to an electrical trip signal on conductors 66 and 68 from monitoring circuit 36. Monitoring circuit 36 preferably provides the electrical trip signal when a fault, error, or other trip condition is sensed. Alternatively, trip control 54 may directly monitor conductors 10, 12 and 14 to determine if a trip condition exists.

Monitoring circuit 36 monitors the current flow to load 22 based upon the level of current produced by current transformers 42, 44 and 46. When the level of the current reaches a predetermined amount associated with a trip condition, monitoring circuit 36 provides a trip signal on conductors 66 and 68. Preferably, monitoring circuit 36 provides a trip signal by providing a ground voltage level on conductor 68 and a rail voltage level on conductor 66. Alternatively, other types of electrical signals could be utilized.

Transformers 42, 44 and 46 are electromagnetically coupled to conductors 14, 12 and 10, respectively. Based upon the current monitored at transformers 42, 44 and 46, circuit 36 provides the electric trip signal via conductors 66 and 68. Monitoring circuit 36 may be configured to sense a variety of trip conditions including ground faults, arcing conditions, or other fault conditions.

Although monitoring circuit 36 is preferably a microprocessor-controlled monitoring circuit along the lines of those described in co-pending U.S. application Ser. No. 08/201,844, entitled "Hybrid Overload Relay", invented by Doerwald, and assigned to the assignee of the present invention, other monitoring circuits 36 may be utilized. Also, monitoring circuit 36 may be an analog circuit capable of sensing an overload condition. Alternatively, monitoring circuit 36 may be a less sophisticated circuit which measures the current through circuit breaker 58 with a shunt resistor (not shown) and provides the trip signal when the threshold current is reached. Further still, monitoring circuit 36 may be an analog comparator circuit for determining the presence of a trip condition or utilize a resistive element to provide a heat trip signal to control 54.

Power to monitoring circuit 36 can be provided by current transformers 42, 44 and 46, or power can be provided by a fourth current transformer (not shown). However, due to the size of current transformers required to produce sufficient power to power circuit 36, external power sources may be utilized.

With reference to FIG. 2, mechanical plunger control system 63 includes plunger mechanism 62, latch 70, and trip control 54. Trip control 54 includes inputs 97 and 99 for receiving electric signals from conductors 66 and 68, respectively. Preferably, when the trip signal is provided, conductor 68 receives a ground voltage level and conductor 66 receives a rail voltage level. Trip control 54 preferably includes a memory wire 92 such as a nickel-titanium wire (e.g., Flexinol™) coupled through loop attachment 94 which is fixed to latch 70.

Plunger mechanism 62 includes an assembly housing 86 and a spring 84. Latch 70 and spring 84 are mechanically fixed to assembly housing 86. A flange 89 of plunger 64 bears against spring 84. When plunger 64 is captured in the first position (shown in FIG. 2), spring 84 is compressed between flange 89 and assembly housing 86. Therefore, plunger 64 is biased or loaded when plunger 64 is in the first position. A hook portion 96 of latch 70 engages a flange 98 of plunger 64 to capture plunger 64 in the biased position. When plunger 64 is in the biased or first position, plunger 64 is staged to trip (e.g., to engage) trip bar 80.

Trip bar 80 is rotationally coupled to contact arm operating mechanism 81 which is coupled to contact set 18 (not shown in FIG. 2). When trip bar 80 is rotated in a counter-clockwise direction to trip state 105, contact arm operating assembly 81 opens contacts 24, 26 and 28. When the trip bar is rotated clockwise to reset state 107, contacts 24, 26, and 28 may be closed by the contact arm operating mechanism via the circuit breaker operating handle.

The operation of plunger control system 63 is described below with reference to FIG. 2. Trip bar 80 is driven to trip state 105 by an end 104 of plunger 64 when plunger 64 travels from the first position to the second position. As spring 84 expands, plunger 64 travels to the second position and end 104 of plunger 64 engages trip bar 80. End 104 turns trip bar 80 in a counter-clockwise direction to trip state 105 as plunger 64 reaches the second position. Plunger control 54 initiates the travel of plunger 64 from the first position to the second position in response to the trip signal at inputs 97 and 99. When the trip signal is provided on conductors 66 and 68, metal wire 92 (e.g., memory metal wire) contracts or shrinks in response to the trip signal and pulls latch 70 away from plunger 64. When metal wire 92 contracts, hook section 96 of latch 70 clears flange 98 and plunger 64 is thrust from the first position to the second position. When plunger 64 engages trip bar 80, trip bar 80 is rotated counter-clockwise to trip state 105 and contacts 24, 26 and 28 (FIG. 1) are opened by the contact arm operating mechanism (not shown).

Alternatively, metal wire 92 may receive a heat signal, or other energy signal. Generally, when metal wire 92 receives energy, metal wire 92 changes shape. Metal wire 92 preferably contracts similar to the action of a muscle jerk when energy is applied to it and is one or more nickel-titanium wires.

After circuit breaker 58 is tripped, trip bar 80 may be reset by manipulating mechanism 81 (FIG. 1). Based upon the operation of contact operating mechanism 91 via the circuit breaker operating handle (not shown), trip bar 80 is rotated clockwise and engages plunger 64. Trip bar 80 preferably pushes end 104 of plunger 64 so that plunger travels from the second position to the first position (e.g., the biased position). If metal wire 92 has recovered from its deformation, hook section 96 re-engages flange 98 and latch 70 re-captures plunger 64.

Thus, system 63 provides an advantageous mechanical trip apparatus utilizing a memory wire trip control. In accordance with the preferred exemplary embodiment of the present invention, mechanical plunger control system 63 preferably includes components which cooperate to provide a low energy, memory metal actuated device which trips circuit breaker 58 in response to an overload or other trip condition. System 63 may advantageously replace magnetic latches, shunt trip devices, undervoltage relays, overload relays, and other load protection circuits in electric switches. Additionally, the streamlined mechanical structure of system 63 enables it to be retrofitted into existing circuit breaker or switch designs which utilize plunger 64. Parts such as spring 84, plunger 64, latch 70 and metal wire 92 may be easily retrofitted into existing circuit breakers such as circuit breaker 58 or other electric switches. Memory wire 92 does not require large amounts of current, heat, or other energy to initiate the tripping of circuit breaker 58. Therefore, system 63 provides a low energy, electromechanical interface between the electronic circuitry and mechanical trip system of an electrical switch such as circuit breaker 58. System 63 also advantageously utilizes a low cost, mechanical latching, spring loaded plunger 64 to manipulate trip bar 80.

It will be understood that the description above is of the preferred exemplary embodiment of the invention and that the invention is not limited to the specific forms shown and described. For example, various detection circuits and trip signals (including heat signals) may be utilized. By way of another modification, system 8 and circuit 36 could be modified to operate with a neutral conductor in addition to the phase conductors. Further, the present invention may be utilized with various types of trip bars, contact arm operating mechanisms, cross-bar assemblies, or other devices for manipulating contacts. Other substitutions, modifications, changes and omissions may be made in the design and arrangement of the preferred embodiment without departing from the spirit of the invention as expressed in the appended claims.

What is claimed is:

1. A system for interrupting current flow in a circuit breaker, the circuit breaker including a contact operating mechanism mechanically coupled to at least one contact and a trip bar, the trip bar capable of residing in a trip state where the current flow through the contact is interrupted, the system comprising:

a plunger positioned proximate the trip bar, the plunger residing in a first state and a second state;

a spring mechanically coupled to the plunger, the spring biasing the plunger towards the second state when the plunger is in the first state;

a latch positioned to releasably capture the plunger in the first state; and a memory metal actuator coupled to the latch, the memory metal actuator releasing the latch in response to a trip signal so that the plunger changes from the first state to the second state and engages the trip bar, thereby forcing the trip bar to the trip state;

the memory metal actuator comprising a length of memory wire that changes lengthwise in response to a change in the wire and that is disposed to release the latch by acting on the latch in a direction along which the wire changes in length; and occurrence of a trip signal causing a change in the wire that changes the wire's length to release the latch.

2. The system of claim 1, further comprising:

a switch arm coupled to the trip bar, the switch arm capable of forcing the trip bar from the trip state to a reset state.

3. The system of claim 2 wherein the trip bar forces the plunger into the first state when the trip bar enters the reset state.

4. The system of claim 1 wherein the metal wire is a nickel titanium wire.

5. The system of claim 4 wherein a microprocessor based sense circuit provides the trip signal.

6. A method of tripping an electric switch in response to a trip condition, the electric switch including a trip bar, a plunger mechanism, and memory wire, the plunger mechanism being positioned to move the trip bar from a reset state to a trip state, the memory wire being coupled to the plunger mechanism, the method comprising steps of:

providing an electric signal to the memory wire;

contacting the length of the memory wire from a first shape to a second shape in response to the electric signal; and moving the trip bar from the reset state to the trip state with the plunger mechanism in response to the memory wire changing from the first shape to the second shape.

7. The method of claim 6 further comprising steps of:

placing the trip bar in the reset state after the memory wire reaches the first shape; and positioning the plunger mechanism to move the trip bar from the reset state to the trip state in response to the memory wire changing from the first shape to the second shape.

8. The method of claim 6 wherein the memory wire is coupled to a latch element in the plunger mechanism.

9. The method of claim 6 wherein the metal wire is a nickel titanium wire.

10. The method of claim 6 wherein the electrical signal is a microprocessor based sense trip signal.

11. A circuit breaker comprising:

a set of contacts;

a trip means, operatively mechanically coupled to the set of contacts, for disengaging the set of contacts in response to a mechanical motion;

a plunger means for providing the mechanical motion to the trip means so that the set of contacts are engaged when the plunger means is in a released state;

a latch means, mechanically couplable to the plunger means, for preventing the plunger means from attaining the released state when the latch means is in a latched state, the latch means allowing the plunger means to attain the released state when the latch means is in an unlatched state; and a length of memory wire that changes lengthwise in response to a change in the wire and that is mechanically coupled to the latch means, the memory wire moving the latch means to the unlatched state by acting on the latch means in a direction along which the wire changes in length in response to a change of length resulting from a change in the memory wire.

12. The circuit breaker of claim 11 wherein the memory wire is electrically coupled to an input, the input receiving an electrical trip signal.

13. The circuit breaker of claim 11 wherein the trip bar is rotationally coupled to the set of contacts.

14. In an override mechanism for a switch having a plurality of contacts, the override mechanism comprising a plunger mechanism, and a latch, the plunger mechanism being retained in a biased position by the latch, the plurality of contacts being closed when the plunger mechanism is in the biased position, the improvement comprising:

a length of memory wire that changes lengthwise in response to a change in the wire and that is coupled to the latch to release the latch by acting on the latch in a direction along which the wire changes in length, the release of the latch releasing the plunger mechanism from the biased position in response to a change in the memory wire, whereby the plunger mechanism reaches a tripped position and causes the plurality of contacts to open.

15. The override mechanism of claim 14 wherein the memory wire shrinks in response to heat.

16. The override mechanism of claim 15 wherein the metal wire is a nickel titanium wire.

17. The override mechanism of claim 16 wherein the metal wire is deformed by an electric trip signal.

18. The override mechanism of claim 14 wherein the plunger mechanism includes a trip bar rotationally coupled to the plurality of contacts.

19. The override mechanism of claim 14 further comprising an override reset lever coupled to the plunger mechanism, the override reset lever forcing the plunger mechanism to the biased position.

20. The system of claim 1 wherein the memory wire changes length in response to a change in electric current in the memory wire, and occurrence of the trip signal causes electric current to begin to flow in the memory wire, changing the memory wire's length to release the latch.

21. The system of claim 20 wherein the memory wire has spaced apart opposite ends both of which are spaced from the wire's coupling to the latch.

22. The system of claim 20 wherein the memory wire contracts in length to exert a pulling force on the latch in response to electric current flow in the wire.

23. The system of claim 20 wherein the latch comprises an elongate member, and the memory wire contracts in length to cause a lateral force to be exerted on the elongate member to release the latch in response to electric current flow in the wire.

24. The system of claim 20 wherein the memory wire has a curved shape at its coupling to the latch.

25. The system of claim 1 wherein the memory wire contracts in length to exert a pulling force on the latch in response to a change in the wire.

26. The circuit breaker of claim 11 wherein the memory wire changes length to release the latch means in response to a change in electric current in the memory wire.

27. The circuit breaker of claim 26 wherein the memory wire has spaced apart opposite ends both of which are spaced from the wire's coupling to the latch means.

28. The circuit breaker of claim 26 wherein the memory wire contracts in length to exert a pulling force on the latch means in response to a change in electric current in the wire.

29. The circuit breaker of claim 26 wherein the latch means comprises an elongate member, and the memory wire contracts in length to cause a lateral force to be exerted on the elongate member to release the latch means in response to a change in electric current in the wire.

30. The circuit breaker of claim 26 wherein the memory wire has a curved shape at its coupling to the latch means.

31. The circuit breaker of claim 11 wherein the memory wire contracts in length to exert a pulling force on the latch means in response to a change in the wire.

32. The improvement of claim 14 wherein the memory wire changes length to release the latch in response to a change in electric current in the memory wire.

33. The improvement of claim 32 wherein the memory wire has spaced apart opposite ends both of which are spaced from the wire's coupling to the latch.

34. The improvement of claim 32 wherein the memory wire contracts in length to exert a pulling force on the latch in response to a change in electric current in the wire.

35. The improvement of claim 32 wherein the latch comprises an elongate member, and the memory wire contracts in length to cause a lateral force to be exerted on the elongate member to release latch in response to a change in electric current in the wire.

36. The improvement of claim 32 wherein the memory wire has a curved shape at its coupling to the latch.

37. The improvement of claim 14 wherein the memory wire contracts in length to exert a pulling force on the latch in response to a change in the wire.

* * * * *

UNITED STATES PATENT AND TRADEMARK OFFICE

CERTIFICATE OF CORRECTION

PATENT NO. : 5,629,662

DATED : May 13, 1997

INVENTOR(S) : Bruce G. Floyd; Jack E. Steinhilper

It is certified that error appears in the above-indentified patent and that said Letters Patent is hereby corrected as shown below:

Column 7

In claim 6, line 8, replace "contacting" with --contracting--.

Signed and Sealed this

Sixteenth Day of December, 1997

Bruce Lehman

*Attest:*

BRUCE LEHMAN

*Attesting Officer*

*Commissioner of Patents and Trademarks*